US006505372B1

(12) United States Patent
Drozd

(10) Patent No.: US 6,505,372 B1
(45) Date of Patent: Jan. 14, 2003

(54) WIRE CLEANING APPARATUS AND METHOD

(75) Inventor: Michael Drozd, Hamden, CT (US)

(73) Assignee: Amphenol Corporation, Wallingford, CT (US)

( * ) Notice: Subject to any disclaimer, the term of this patent is extended or adjusted under 35 U.S.C. 154(b) by 96 days.

(21) Appl. No.: 09/793,088

(22) Filed: Feb. 27, 2001

(51) Int. Cl.[7] ..... B08B 1/02
(52) U.S. Cl. ..... 15/97.1; 15/102; 15/104.04
(58) Field of Search ..... 15/97.1, 100, 102, 15/103.5, 104.04

(56) References Cited

U.S. PATENT DOCUMENTS

| | | | | |
|---|---|---|---|---|
| 1,949,868 | A | * | 3/1934 | Keuffel |
| 3,604,039 | A | | 9/1971 | Aldridge |
| 3,644,953 | A | * | 2/1972 | Christiansen |
| 3,702,489 | A | | 11/1972 | Nakamura et al. |
| 3,845,533 | A | | 11/1974 | Tinfow et al. |
| 3,852,109 | A | | 12/1974 | Cheetham |
| 3,945,079 | A | * | 3/1976 | Westberg |
| 4,286,449 | A | | 9/1981 | Spreafico |
| 5,613,286 | A | | 3/1997 | McCabe |
| 5,735,013 | A | * | 4/1998 | Yaguchi et al. |

OTHER PUBLICATIONS

Wire Journal International , by: Norman Chow, Cliff Mui and Jim Alexander, Title: High performance cleaning of nonferrous wire, Date: Feb. 2000, pp. 156–159.
Wire and Cable Technology International, by: Frank R. Coleman and Chuck Walus (Coleman Industrial Sales, Inc.), Title: Mechanical In–line Wire Cleaning and Surface Preparation, Date: Mar. 2000, pp. 61–62.

* cited by examiner

*Primary Examiner*—Terrence R. Till
(74) *Attorney, Agent, or Firm*—Blank Rome LLP

(57) ABSTRACT

A wire cleaning device using non-woven fibrous material rolls to wipe the surface of a wire to remove oil, dirt, and other contaminants. The device has a top feeder roller and a top receiving roller, and a complementary bottom feeder roller and receiving roller. The top and bottom rollers provide two sheets of material through which a wire is fed. The material sheets wipe the surface of the wire as it travels from the feeder roller to the receiving roller, providing a continually clean wiping surface.

16 Claims, 3 Drawing Sheets

WIRE CLEANING APPARATUS AND METHOD

FIELD OF THE INVENTION

The present invention is directed to a method and apparatus for a wire cleaning device that uses non-woven fibrous material on rolls to remove dirt and oil from metal wires prior to the application of an insulating material by an extruder.

BACKGROUND OF THE INVENTION

The removal of dirt, oil, and other contaminants from a wire prior to the application of an insulation or coating is crucial to ensuring the durability and effectiveness of the wire as a conductor of electrical signals in electrical wires. Dirty wires lead to a variety of problems, including poor coating bonding, wire breaks, spark faults and other deficiencies in the final product. Furthermore, dirty wires can result in reducing the effectiveness of subsequent extruder tooling operations, such as the clogging of extrusion tips.

A common approach to cleaning wires is to use brushes to remove scale and slag from a wire's surface. U.S. Pat. Nos. 4,268,449 to Spreafico and 5,613,286 to McCabe disclose wire cleaners consisting of wire brushes which sweep the wire's exterior surface to wipe away any contaminants thereon. However, the wire brushes in Spreafico and McCabe are designed to remove scale and slag and do not effectively remove oil, dirt and other small viscous contaminants.

Other methods of cleaning a wire use a combination of detergent baths and ultrasonics. However, the use of detergent baths is disfavored due to the environmental and health risks involved. Also, the use of both detergent baths and ultrasonic methods are expensive and hinder their widespread use.

Another common approach to cleaning a wire is to run the dirty wire through a rag or set of felt wipers. However, this method is time consuming and ineffective because the rags become dirty quickly and must be replaced often, leading to frequent instances when the machines must be shut down for maintenance.

In view of the foregoing deficiencies, it would be desirable to have a wire cleaning device that removes oil, dirt and other contaminants from a wire in an efficient and cost-effective manner.

SUMMARY OF THE INVENTION

The present invention is directed to a wire cleaning device using a pair of non-woven fibrous material web or sheets on rolls to wipe the surface of a wire to remove oil, dirt and other contaminants. A continuous web or sheet of the material is fed from a top feeder roll to a top receiver roll and from a bottom feeder roll to a bottom receiver roll. The two sheets are positioned in close proximity to one another by a pair of guiding plates. A wire is fed between the top and bottom sheets such that the two sheets encircle the wire and clean its entire surface. The non-woven fibrous material sheet is constantly fed from the feeder roller to the receiver roller to provide a continuously clean wiping surface for the wire and prevents the sheet from clogging up with debris. This ensures that the wire is properly cleaned when leaving the device.

While a variety of non-woven fibrous material can be used, including polyester, polyesterblends, rayon, polyolefins, cellulose, cellulose blends, cotton and cotton blends, it has been determined that a non-woven polyester and rayon blend offers the best wiping characteristics providing a sheet with adequate strength and lint-free debris.

DETAILED DESCRIPTION OF THE PREFERRED EMBODIMENTS

Figure 1:
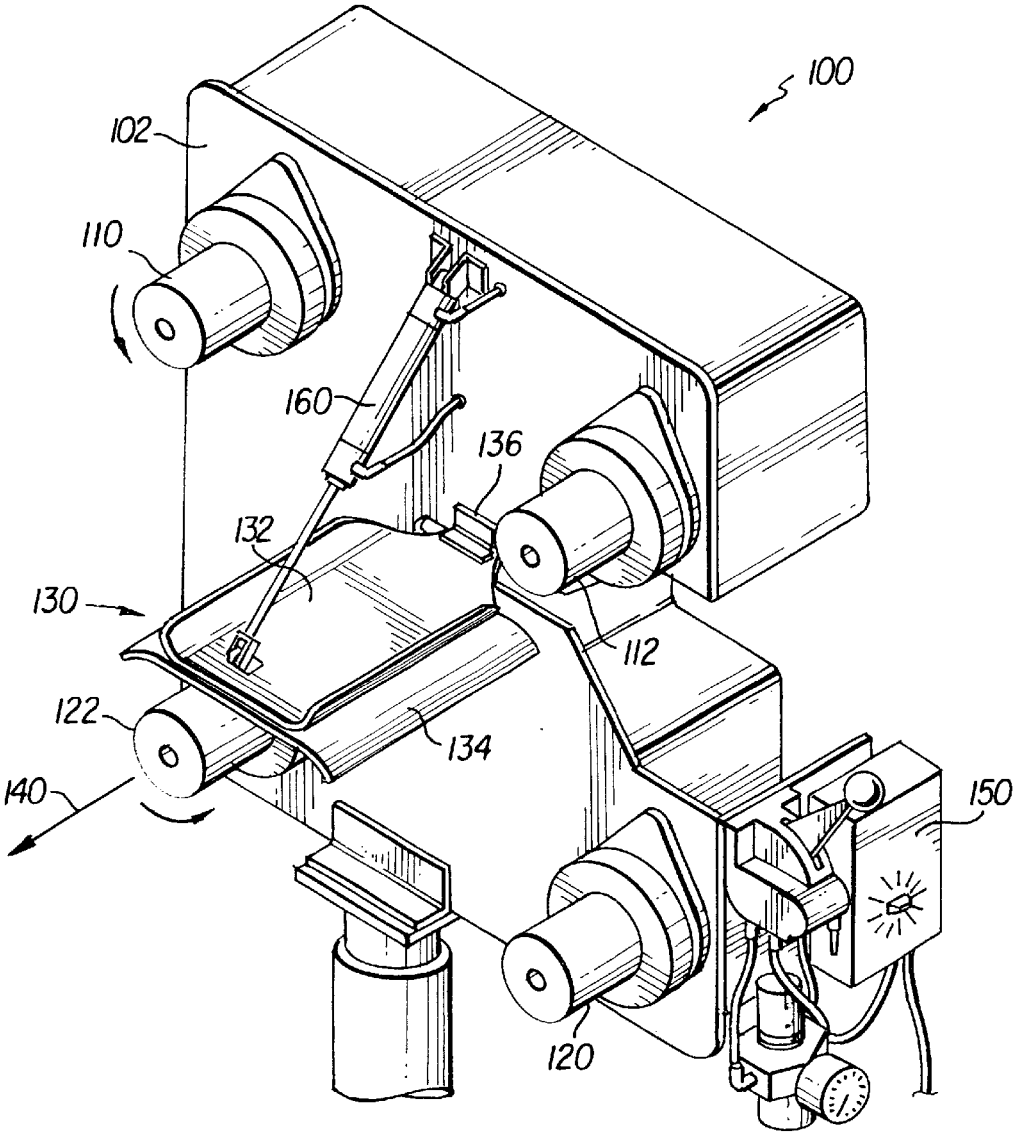
FIG. 1 is a perspective view of the front of a wire cleaning device of the present invention.

The present invention will be set forth in detail with reference to the drawings, in which like reference numerals refer to like components throughout.

Figure 2:
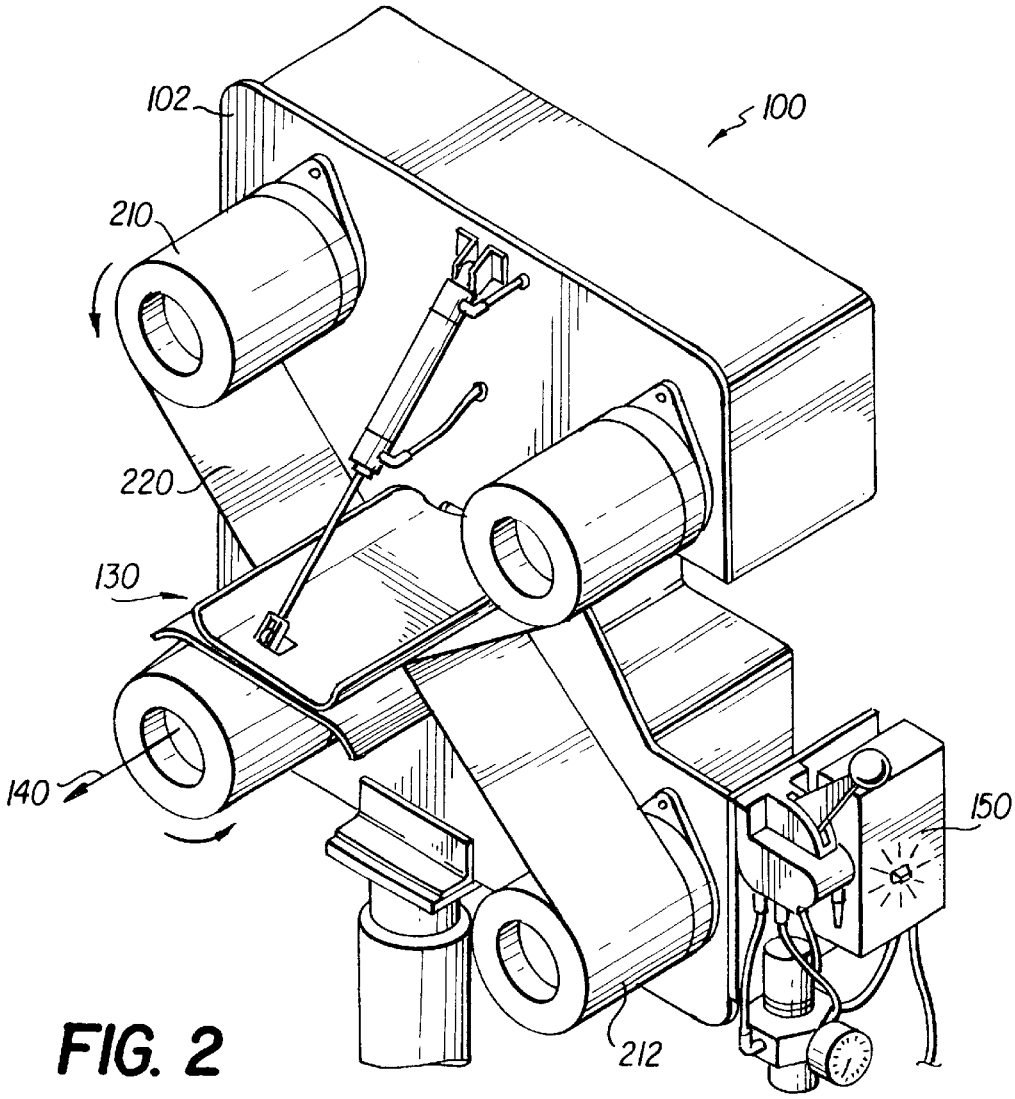
FIG. 2 is a perspective view of the front of the wire cleaning having non-woven fibrous rolls thereon.

FIGS. 1 and 2 show perspective views of a wire cleaner device 100 of the present invention. The device contains two pairs of rollers, a top pair 110, 112 and a bottom pair 120, 122. A non-woven fibrous material roll 210 is placed on a feeder roller 110and this material is fed to a receiving roller 112. A second non-woven fibrous material roll 212 is placed on a second feeder roller 120 and this material is fed to a second receiving roller 122.

The rollers 110, 112, 120 and 122 are attached to a base plate 102 with the feeder rollers 110 and 120 located diagonally from each other. The feeder rollers 110 and 120 feed a web or sheet of non-woven fibrous material 220 in opposite directions. The top feeder roller 110 spins in a counter-clockwise direction feeding the material to the top receiving roller 112, with the material traveling from left to right. The bottom feeder roller 120 also spins in a counter-clockwise direction feeding the bottom receiving roller 122, with the material traveling from right to left. The directions the material travels are not important, so long as the top and bottom sheets 220 are traveling in opposite directions. This stabilizes the wire 400 which is fed between sheets 220 and prevents it from being pulled in either direction.

A motor control 150 controls the speed of the material feed. In this way, a user can adjust the speed to optimize the effectiveness of the cleaning action between the material and the wire. The speed of the material flow can be adjusted depending on several factors such as the speed at which the wire is moving through the guide plates, the contamination level of the wire, and the size or diameter of the wire. Calculating a proper material feed speed is necessary because a feed speed that is too slow can cause the wire to cut through and damage the cleaning material and a feed speed that is too fast can lead to under use and wasting of the cleaning material.

Furthermore, it is envisioned that the motor control 150 be designed to ensure a constant material feed speed. The feed speed is determined not by just the rotation speed of the rollers, but also by the diameter of the fibrous material rolls 210 and 212. As the material is fed from the feeders 110 and 120 to the receivers 112 and 122, the diameter of the fibrous material roll on the feeders will shrink. If the rotation of the rollers is kept constant and the diameter of the material roll shrinks, the material feed speed will decrease. The motor control 150 can be designed to compensate for the reduction in material roll diameter by adjusting the rotation speed of the feeder and receiving rollers to maintain a constant feed speed.

Guide plates 130 are located in the center of the base 102, in between the rollers 110, 112, 120 and 122, to provide a guiding means for the material sheets 220 and the wire 400. The guide plates 130 comprise an upper guide plate 132 and a lower guide plate 134. One end of the upper guide plate 132 is pivotably attached to the base 102 by a hinge 136 and the other free end is attached to an arm of an air cylinder 160. The lower guide plate 134 is rigidly fixed to the base 102.

The arm of the air cylinder 160 extends and retracts to move the free end of the upper guide plate 132 into an open and closed position, with the upper guide plate pivoting about its fixed end. The air cylinder 160 allows the pressure applied by the upper guide plate on the wire to be adjusted. Consequently, the user can control the pressure applied by the cleaning material onto the wire to produce an adequate wiping action.

It is also envisioned that the hinge 136 of the upper guide plate 132 be able to move up and down using elongated slots (not shown). This will allow the guide plates to be adjusted to handle wires of various sizes.

Figure 3:
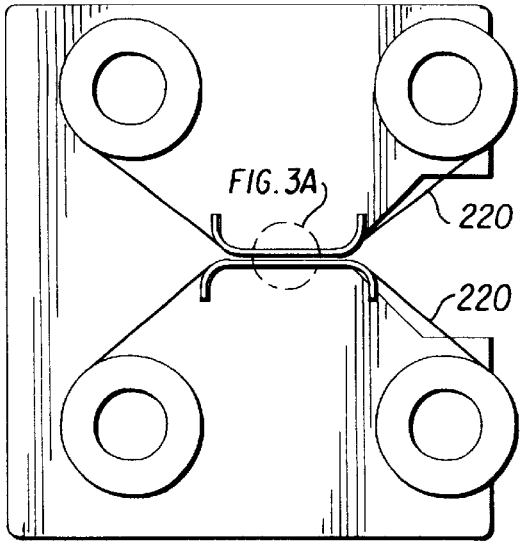
FIG. 3 is a front view of the wire cleaning device
Figure 3A:
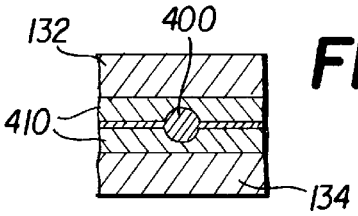
FIG. 3A is an exploded front view of a pair of guide plates of FIG. 3.

The guide plates 130 also function to position the material sheets 220 as it moves from the feeder rollers 110 and 120 to the receiving rollers 112 and 122. The material sheets 220 slide over a flat surface on the inner face of both the upper and lower guide plates 132 and 134, and move in opposite directions adjacent to one another. As shown in FIGS. 3 and 3A, both the guide plates 130 are lined with a thin sheet of a pliant material 410, such as polyurethane foam, to allow the material to form around the wire and clean the entire circumference of the wire. In a preferred embodiment, the pliant material is a ⅛" thick, medium density open cell polyurethane foam tape.

Figure 4:
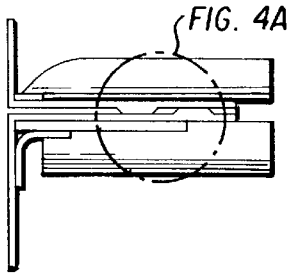
FIG. 4 is a side view of the guide plates of FIG. 3.
Figure 4A:
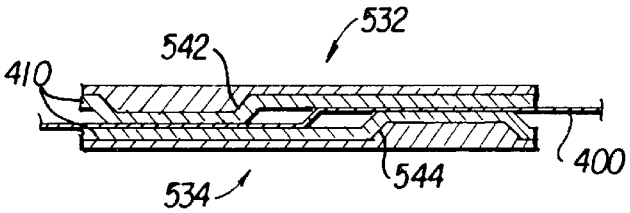
FIG. 4A is an exploded side view of the guide plates of FIG. 4.

In an alternative embodiment shown in FIGS. 4 and 4A, the guide plates 130 have a stepped configuration so that the wire 400 is bent while traveling through the guide plates 130. The upper and lower plates 532 and 534 have shoulders 542 and 544 which guide the wire from a first lower position to a second higher position. The upper shoulder 542 of the upper plate and the base of the lower plate 534 form the first position and the base of the upper plate 532 and the lower shoulder 544 of the lower plate form the higher position. This stepped configuration enhances the wiping action between the material (not shown in FIGS. 4 and 4A) and the wire 400, and results in a cleaner wire.

In operation, the guide plates 130 are moved into their open position and a wire 400 is strung through the center of the guide plates 130 in the wire feed direction 140 which is perpendicular to the material feed direction. The device is then started and the wire is fed through the guide plates 130 as the fibrous material sheets 220 between the guide plates 130 wipe the surface of the wire removing dirt, oil, and other contaminates from its surface.

As the wire is being fed through the device, fresh material is constantly being applied to the wire to provide a continually clean wiping surface and ensure a thorough wiping of the wire. Because of the constant material feed, the device does need to be stopped to remove contaminates from the material's cleaning surface. Instead, when all the material has been used, a new roll of the material is put on the feeder rollers 110 and 120, and the device is quickly and easily restarted.

After testing non-woven fibrous material made of 100% polyester and polyester blends, 100% rayon, 100% polyolefins, cellulose and cellulose/polyester blends, 100% cotton and cotton blends, it was determined that a thin sheet of a non-woven polyester and rayon blend offered the best wiping characteristics providing a material with adequate strength and lint-free debris.

The wiping characteristics of this material are:

Basis Weight: 36 grams per square meter (ASTM-D3776)

Caliper: 0.0155 inches (ASTM-D1777)

MD Tensile Strength: 10 pounds per inch (ASTM-D5035)

MD % Elongation: 20%

CD Tensile Strength: 2.2 pounds per inch

CD Elongation: 60%

Although only preferred embodiments are specifically illustrated and described herein, it will be appreciated that many modifications and variations of the present invention are possible in light of the above teachings departing from the spirit and intended scope of the invention.

What is claimed is:

1. An apparatus for cleaning a wire comprising:

a first sheet of a fibrous material disposed to contact a portion of the surface of a wire to be cleaned;

a second sheet of a fibrous material disposed to contact a portion of the wire that is not contacted by the first sheet, wherein said first and second sheets of non-woven fibrous material are moved in opposite directions when the wire is being cleaned.

2. The apparatus for cleaning a wire of claim 1, wherein:

said fibrous material is a lint-free, non-woven, polyester and rayon blend.

3. The apparatus for cleaning a wire of claim 1, further comprising:

a first and second feeder roller and a first and second receiver roller;

fibrous material rolls placed on said feeder rollers, and wherein the material roll on the first feeder roller supplies a continuous first sheet of fibrous material and the material roll on the second feeder roller supplies a continuous second sheet of fibrous material.

4. The apparatus for cleaning a wire of claim 3, further comprising:

guide plates for positioning said first and second sheets to contact the wire, wherein said guide plates are located in between the feeder rollers and the receiver rollers.

5. The apparatus for cleaning a wire of claim 4, wherein:

said guide plates have a soft lining to allow the fibrous sheets to bend around the wire.

6. An apparatus for cleaning a wire comprising:

feeder rollers and receiver rollers;

fibrous material rolls which are placed on the feeder rollers to provide a continuous sheet of fibrous material to wipe a surface of a wire; and guide plates located in between the rollers for positioning the fibrous material sheets to contact the wire.

7. The apparatus for cleaning a wire of claim 6, wherein:

the fibrous rolls are a lint-free, non-woven, polyester and rayon blend.

8. The apparatus for cleaning a wire of claim 6, wherein:

the guide plates have a soft lining so that the fibrous sheets may bend around the wire.

9. The apparatus for cleaning a wire of claim 8, wherein:

the soft lining is a polyurethane foam.

10. The apparatus for cleaning a wire of claim 6, wherein:

one end of the guide plates is pivotably attached to a base of the apparatus, and an arm of a cylinder is attached to a free end of the guide plates, wherein the arm is extensible and retractable to move the guide plates into an open and closed position.

11. The apparatus for cleaning a wire of claim 6, wherein:

the guide plates have a stepped configuration for moving the wire from a first position to a second position.

12. The apparatus for cleaning a wire of claim 11, wherein:

the guide plates comprise a first and second guide plate, the first guide plate having a shoulder cooperating with a base of the second guide plate to form the first position, and the second guide plate having a shoulder cooperating with a base of the first guide plate to form the second position.

13. The apparatus for cleaning a wire of claim 6, further comprising:

a motor control for controlling a feed speed of the rollers.

14. The apparatus for cleaning a wire of claim 13, wherein:

the motor control is able to keep a constant feed speed.

15. The apparatus for cleaning a wire of claim 6, wherein:

the rollers comprise two pairs of rollers, a first pair and a second pair, each pair having a feeder roller and a receiving roller;

wherein the fibrous material rolls are placed on the feeder rollers and feed the fibrous material sheets to the corresponding receiving rollers and the two pairs of rollers feed the sheets in opposite directions.

16. The apparatus for cleaning a wire of claim 15, wherein:

the fibrous material rolls feed the fibrous sheets in a direction perpendicular to the axis of the wire.

* * * * *